US005494176A

United States Patent [19]

Zallo

[11] Patent Number: 5,494,176

[45] Date of Patent: Feb. 27, 1996

[54] CHILD SAFE CUTLERY SET HOLDER

[76] Inventor: Silvio Zallo, 1151 Neill Ave., Bronx, N.Y. 10461

[21] Appl. No.: 263,690

[22] Filed: Jun. 22, 1994

[51] Int. Cl.[6] ..... A47F 7/00

[52] U.S. Cl. ..... 211/70.7; 211/70.6; 248/37.6; D7/638; 30/138

[58] Field of Search ..... 211/70.7, 70.6; 248/37.3, 37.6; 30/138; 76/82; D7/637, 638; 451/455, 461, 486, 540

[56] References Cited

U.S. PATENT DOCUMENTS

| | | | |
|---|---|---|---|
| D. 232,899 | 9/1974 | Bayly | D7/638 |
| 2,413,169 | 12/1946 | Case | 248/37.6 X |
| 2,441,690 | 5/1948 | Dirkson | 248/37.6 X |
| 3,774,350 | 11/1973 | Bayly | 30/138 X |
| 3,861,246 | 1/1975 | Waller | 30/138 X |
| 4,348,809 | 9/1982 | Jackson | 30/138 |
| 4,866,845 | 9/1989 | McEvily | 30/138 |

*Primary Examiner*—Robert W. Gibson, Jr.
*Attorney, Agent, or Firm*—Michael I. Kroll

[57] ABSTRACT

A child safe cutlery set holder for an overhead cabinet in a kitchen which comprises a housing and a plurality of sheaths, built into the housing in side by side relationships. Components are for mounting the housing to the underside of the overhead cabinet. Each sheath faces forward to hold a blade of one knife therein with it's handle extending therefrom, so as to keep the knives out of the reach of small children.

13 Claims, 2 Drawing Sheets

CHILD SAFE CUTLERY SET HOLDER

BACKGROUND OF THE INVENTION

1. Field of the Invention

The instant invention relates generally to cutting utensil cases and more specifically it relates to a child safe cutlery set holder.

2. Description of the Prior Art

Numerous cutting utensil cases have been provided in prior art that are adapted to retain knives in storage for future use. While these units may be suitable for the particular purpose to which they address, they would not be as suitable for the purposes of the present invention as heretofore described.

SUMMARY OF THE INVENTION

A primary object of the present invention is to provide a child safe cutlery set holder that will overcome the shortcomings of the prior art devices.

Another object is to provide a child safe cutlery set holder that is mounted to the underside of a base of an overhead cabinet, so as to keep knives out of the reach of small children.

An additional object is to provide a child safe cutlery set holder that is constructed so that each blade of each knife will be held in place and not fall out within a built-in rearwardly angled sheath in the housing, while at the same time the slot of the sheath has an abrasive lower V-portion which will sharpen the blade of the knife when inserted therein.

A further object is to provide a child safe cutlery set holder that is simple and easy to use.

A still further object is to provide a child safe cutlery set holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a front perspective view of a portion of a kitchen showing the instant invention mounted to the underside of an overhead cabinet.

FIG. 2 a cross sectional side view taken along line 2—2 in FIG. 1 through the overhead cabinet.

DETAILED DESCRIPTION OF THE PREFERRED EMBODIMENTS

Figure 1:
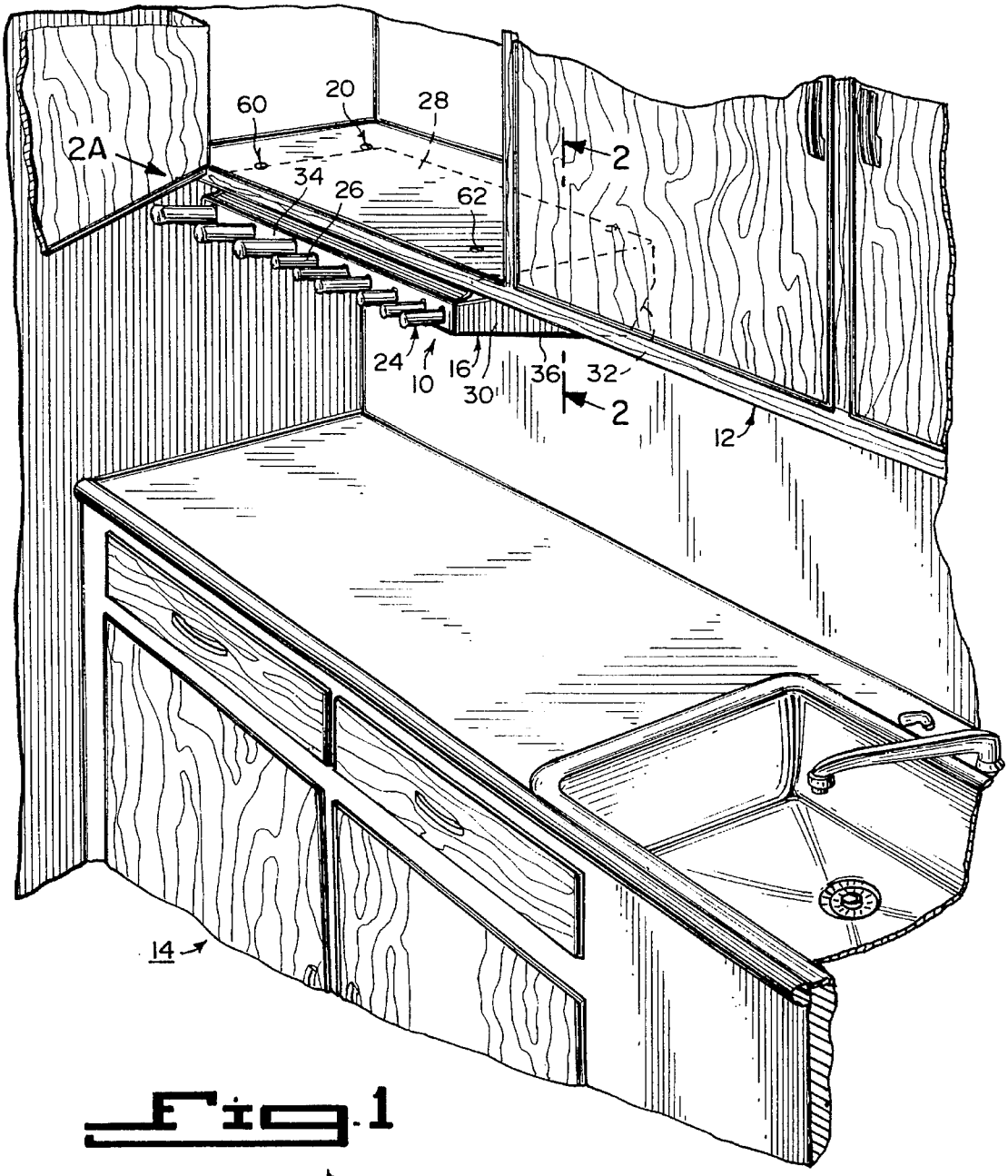
Figure 2:
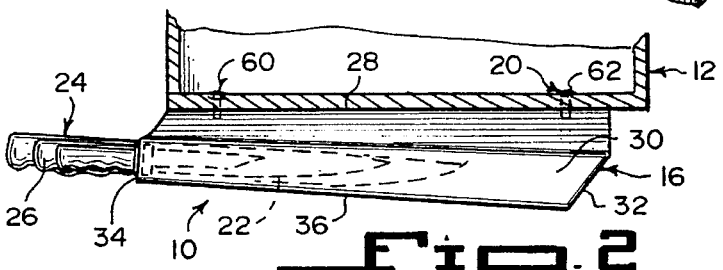
FIG. 2A is an enlarged front perspective view with parts broken away taken in the direction of arrow 2A in FIG. 1.
Figure 2A:
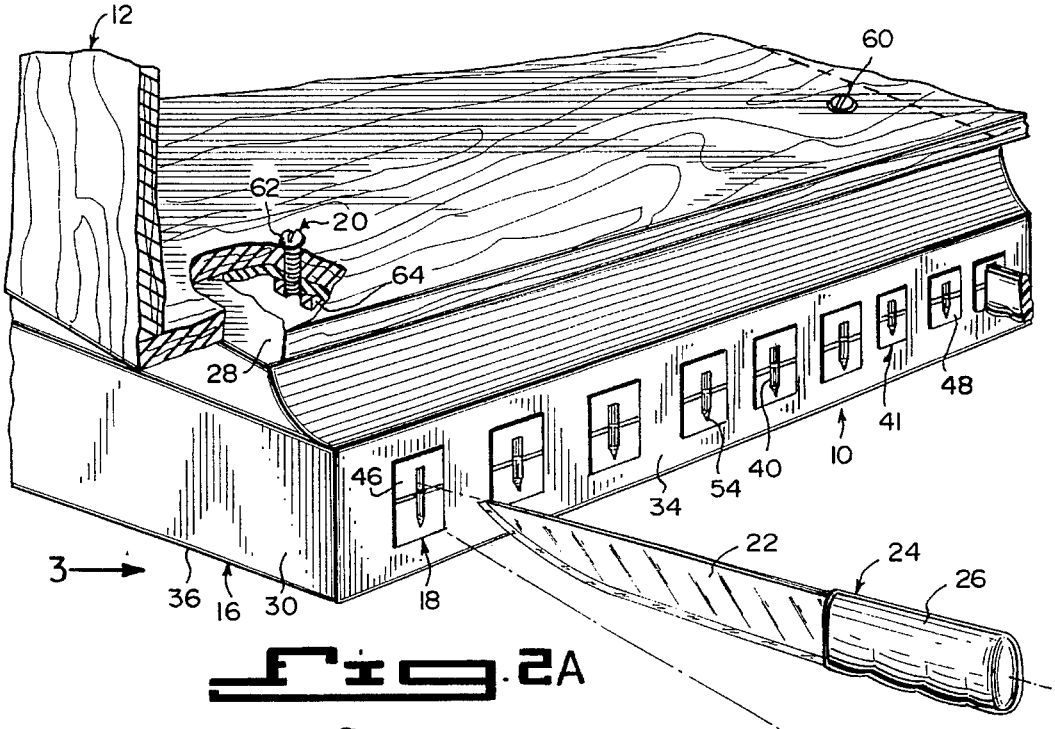
Figure 3:
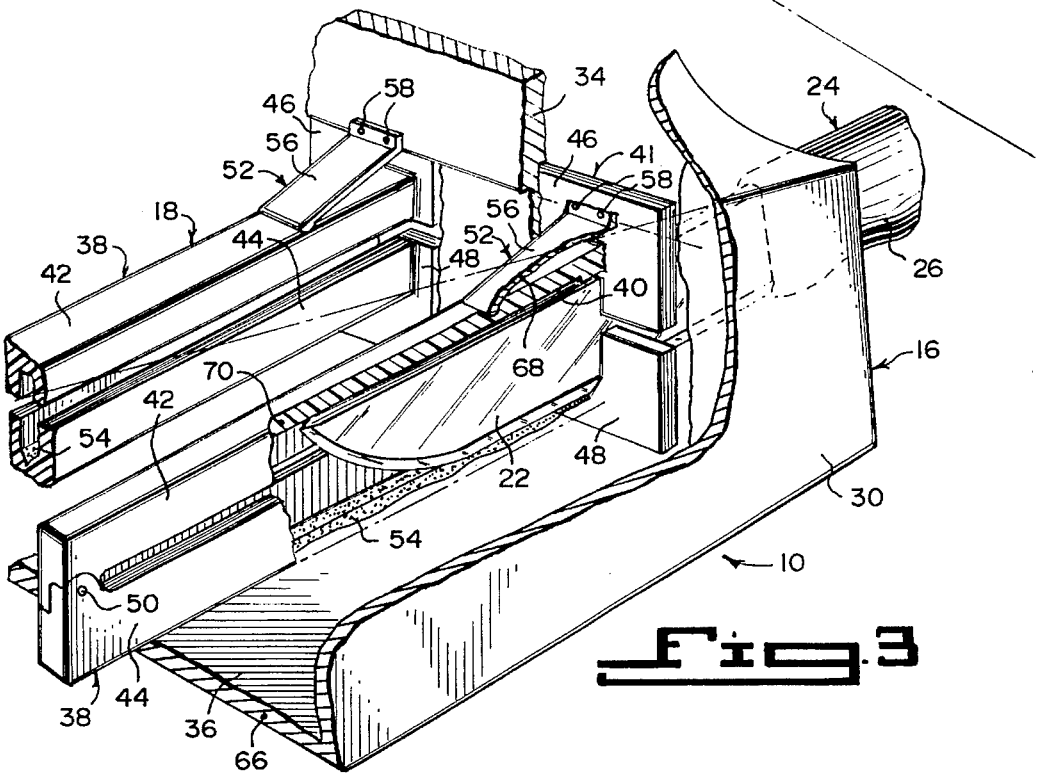
FIG. 3 is a further enlarged rear perspective view with parts broken away taken in the direction of arrow 3 in FIG. 2A, showing the structure of the sheaths therein in greater detail.

Turning now descriptively to the drawings, in which similar reference characters denote similar elements throughout the several views, FIGS. 1 through 3 illustrate a child safe cutlery set holder 10 for an overhead cabinet 12 in a kitchen 14, which comprises a housing 16 and a plurality of sheaths 18 built into the housing 16 in side by side relationships. Components 20 are for mounting the housing 16 to the underside of the overhead cabinet 12. Each sheath 18 faces forward to hold a blade 22 of one knife 24 therein with it's handle 26 extending therefrom, so as to keep the knives 24 out of the reach of small children.

The housing 16 contains a top wall 28. A pair of side walls 30 extend downwardly from the top wall 28. A rear wall 32 extends downwardly from the top wall 28. A front wall 34 extends downwardly from the top wall 28. The front wall 34 has a plurality of apertures (not shown), to receive the sheaths 18 extending therein. A bottom wall 36 extends at an angle rearwardly, so that the sheaths 18 are sloped down towards the rear wall 32, in which each blade 22 of each knife 24 will be held in place and not fall out of the housing 16.

Each sheath 18 includes a sleeve 38 having a slot 40 to hold a blade 22 of one knife 24 therein. A front plate 41 is on the sleeve 38, so that the sleeve 38 can be inserted into one aperture in the front wall 34 with the front plate 41 up against the front wall 34 of the housing 16.

Each sleeve 38 is longitudinally divided into an upper segment 42 and a lower segment 44. The front plate 41 is transversely divided into an upper section 46 and a lower section 48. A pivot assembly 50 is located at a rear end of the sleeve 38 between the upper segment 42 and the lower segment 44. A structure 52 is for biasing the upper segment 42 towards the lower segment 44, so as to hold the blade 2 of the knife 24 in place within the slot 40 of the sleeve 38. Each slot 40 in each sleeve 38 of each sheath 18 has a bottom abrasive V-portion 54 located in the lower segment 44, which will sharpen the blade 22 of the knife 24 when inserted within the slot 40.

The biasing structure 52 includes a flat spring 56. Fasteners 58 are for attaching a first end of the flat spring 56 to an inner surface of the front wall 34 of the housing 16. A second end of the flat spring 56 will contact a top surface of an upper segment 42 of the sleeve 38 of one sheath 18.

The mounting components 20 are a plurality of fastener assemblies 60. Each fastener assembly 60 includes a bolt 62, having a threaded shank extending through an aperture in a base of the overhead cabinet 12 and into a hole in the top wall 28 of the housing 16. A nut 64 is threaded onto the threaded shank of the bolt 62.

The housing 16 is fabricated out of a durable non-corrosive material 66. The durable non-corrosive material 66 of the housing 16 is stainless steel. Each flat spring 56 is fabricated out of a durable non-corrosive flexible material 68. The durable non-corrosive flexible material 68 of each flat spring 56 is stainless steel.

Each sheath 18 is fabricated out of a durable non-corrosive material 70. The durable non-corrosive material 70 of each sheath 18 is a hard plastic.

| LIST OF REFERENCE NUMBERS | |
|---|---|
| 10 | child safe cutlery set holder |
| 12 | overhead cabinet |
| 14 | kitchen |
| 16 | housing |
| 18 | sheath in 16 |
| 20 | mounting component |
| 22 | blade of 24 |
| 24 | knife |

-continued

| LIST OF REFERENCE NUMBERS | |
|---|---|
| 26 | handle of 24 |
| 28 | top wall of 16 |
| 30 | side wall of 16 |
| 32 | rear wall of 16 |
| 34 | front wall of 16 |
| 36 | bottom wall of 16 |
| 38 | sleeve of 18 |
| 40 | slot in 38 |
| 41 | front plate of 18 |
| 42 | upper segment of 38 |
| 44 | lower segment of 38 |
| 46 | upper section of 40 |
| 48 | lower section of 40 |
| 50 | pivot assembly between 42 and 44 |
| 52 | biasing structure |
| 54 | bottom abrasive V-portion of 40 in 44 |
| 56 | flat spring |
| 58 | fastener for 56 |
| 60 | fastener assembly for 20 |
| 62 | bolt |
| 64 | nut |
| 66 | durable non-corrosive material of 16 |
| 68 | durable non-corrosive flexible material of 56 |
| 70 | durable non-corrosive material of 18 |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A child safe cutlery set holder for an overhead cabinet in a kitchen which comprises:

a) a housing, said housing including a top wall, a pair of side walls extending downwardly from said top wall, a rear wall extending downwardly from said top wall, a front wall extending downwardly from said top wall, with said front wall having a plurality of apertures to receive said sheaths extending therein, and a bottom wall extending at an angle rearwardly, so that said sheaths are sloped down towards said rear wall in which each blade of each knife will be held in place and not fall out of said housing;

b) a plurality of sheaths, built into said housing in side by side relationships; and c) means for mounting said housing to the underside of the overhead cabinet, with each said sheath facing forward to hold a blade of one knife therein with it's handle extending therefrom, so as to keep the knives out of the reach of small children.

2. A child safe cutlery set holder as recited in claim 1, wherein each sheath includes:

a) a sleeve having a slot to hold a blade of one knife therein; and b) a front plate on said sleeve, so that said sleeve can be inserted into one said aperture in said front wall with said front plate up against said front wall of said housing.

3. A child safe cutlery set holder as recited in claim 2, wherein each said sheath further includes:

a) said sleeve being longitudinally divided into an upper segment and a lower segment;

b) said front plate being transversely divided into an upper section and a lower section;

c) a pivot assembly located at a rear end of said sleeve between said upper segment and said lower segment; and d) means for biasing said upper segment towards said lower segment, so as to hold the blade of the knife in place within said slot of said sleeve.

4. A child safe cutlery set holder as recited in claim 3, wherein each said slot in each said sleeve of each said sheath has a bottom abrasive V-portion located in said lower segment which will sharpen the blade of the knife when inserted within said slot.

5. A child safe cutlery set holder as recited in claim 4, wherein said biasing means includes:

a) a flat spring; and b) means for attaching a first end of said flat spring to an inner surface of said front wall of said housing, so that a second end of said flat spring will contact a top surface of an upper segment of said sleeve of one said sheath.

6. A child safe cutlery set holder as recited in claim 5, wherein said mounting means includes a plurality of fastener assemblies.

7. A child safe cutlery set holder as recited in claim 6, wherein each fastener assembly includes:

a) a bolt having a threaded shank extending through an aperture in a base of the overhead cabinet and into a hole in said top wall of said housing; and b) a nut threaded onto said threaded shank of said bolt.

8. A child safe cutlery set holder as recited in claim 7, wherein said housing is fabricated out of a durable non-corrosive material.

9. A child safe cutlery set holder as recited in claim 8, wherein said durable non-corrosive material of said housing is stainless steel.

10. A child safe cutlery set holder as recited in claim 9, wherein each said flat spring is fabricated out of a durable non-corrosive flexible material.

11. A child safe cutlery set holder as recited in claim 10, wherein said durable non-corrosive flexible material of each said flat spring is stainless steel.

12. A child safe cutlery set holder as recited in claim 11, wherein each said sheath is fabricated out of a durable non-corrosive material.

13. A child safe cutlery set holder as recited in claim 12, wherein said durable non-corrosive material of each said sheath is a hard plastic.

* * * * *